US010906338B2

(12) United States Patent
Fujioka et al.

(10) Patent No.: US 10,906,338 B2
(45) Date of Patent: Feb. 2, 2021

(54) AUXILIARY MEMBER AND PRINTING APPARATUS

(71) Applicant: SEIKO EPSON CORPORATION, Tokyo (JP)

(72) Inventors: Satoshi Fujioka, Azumino (JP); Hiroshi Asawa, Yamagata-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/749,656

(22) Filed: Jan. 22, 2020

(65) Prior Publication Data

US 2020/0230982 A1 Jul. 23, 2020

(30) Foreign Application Priority Data

Jan. 23, 2019 (JP) ..... 2019-009170

(51) Int. Cl.

| | |
|---|---|
| ***B41J 15/02*** | (2006.01) |
| ***B41J 15/04*** | (2006.01) |
| ***B41J 13/02*** | (2006.01) |
| ***B65H 19/30*** | (2006.01) |

(52) U.S. Cl.
CPC ..... *B41J 15/042* (2013.01); *B41J 13/025* (2013.01); *B41J 15/02* (2013.01); *B41J 15/04* (2013.01); *B65H 19/305* (2013.01)

(58) Field of Classification Search
CPC ..... B41J 15/042; B41J 15/04; B41J 13/025; B41J 15/02; B65H 19/305
See application file for complete search history.

(56) References Cited

U.S. PATENT DOCUMENTS

2004/0083025 A1 4/2004 Yamanouchi et al.

FOREIGN PATENT DOCUMENTS

| | | |
|---|---|---|
| JP | 2003-155198 | 5/2003 |
| JP | 2016-047754 | 4/2016 |

*Primary Examiner* — Geoffrey S Mruk
(74) *Attorney, Agent, or Firm* — Workman Nydegger

(57) ABSTRACT

An auxiliary member is an auxiliary member that assists in mounting a roll body, which is formed by winding a sheet into a roll shape on a core tube, onto a shaft of a printing apparatus. The auxiliary member includes a cylindrical main body insertable into the core tube, a laser irradiation unit that irradiates laser light from a leading end surface of the main body, and a switch that switches between irradiation and stopping of the laser light from the laser irradiation unit.

6 Claims, 5 Drawing Sheets

AUXILIARY MEMBER AND PRINTING APPARATUS

The present application is based on, and claims priority from JP Application Serial Number 2019-009170, filed Jan. 23, 2019, the disclosure of which is hereby incorporated by reference herein in its entirety.

BACKGROUND

1. Technical Field

The disclosure relates to an auxiliary member and a printing apparatus.

2. Related Art

In related art, as described, for example, in JP-A-2016-047754, a roll lift device is known that holds a roll and inserts a support shaft of a processing machine into a hollow portion of the roll.

However, when inserting the support shaft of the processing machine into the roll, it is necessary to perform the operation while visually verifying the positions of each of the hollow portion of the roll and the support shaft, and the operation of setting the roll on the processing machine becomes complex.

SUMMARY

An auxiliary member of the present application is an auxiliary member that assists in mounting a roll body, formed by winding a sheet into a roll shape on a core tube, onto a shaft of a printing apparatus. The auxiliary member includes a cylindrical main body insertable into the core tube, a laser irradiation unit configured to irradiate laser light from a leading end surface of the main body, and a switch configured to switch between irradiation and stopping of the laser light from the laser irradiation unit.

A switch of the above-described auxiliary member is preferably an optical sensor, and the laser light is preferably irradiated when the main body is inserted into the core tube.

The switch of the above-described auxiliary member is preferably a push button that is depressed to irradiate the laser light when the main body is inserted into the core tube.

In the above-described auxiliary member, a base portion having a larger dimension than a diameter of the core tube is preferably connected to the main body on an opposite side of the main body from the leading end surface.

The switch of the above-described auxiliary member is preferably provided on the side of a surface, of the base portion, to which the main body is connected.

A printing apparatus according to the present application includes an auxiliary member including a cylindrical main body insertable into a core tube of a roll body formed by winding a sheet into a roll shape on the core tube, a laser irradiation unit irradiating laser light from a leading end surface of the main body, and a switch switching between irradiation and stopping of the laser light from the laser irradiation unit. The printing apparatus also includes a shaft onto which the core tube of the roll body is mounted, and a reflection portion provided on a leading end surface of the shaft and configured to reflect the laser light.

DESCRIPTION OF EXEMPLARY EMBODIMENTS

Exemplary embodiments of the present disclosure will be described below with reference to the accompanying drawings. Note that, in each of the figures below, to illustrate each of members and the like in a recognizable size, each of the members and the like is illustrated to a scale different from an actual scale.

Figure 1:
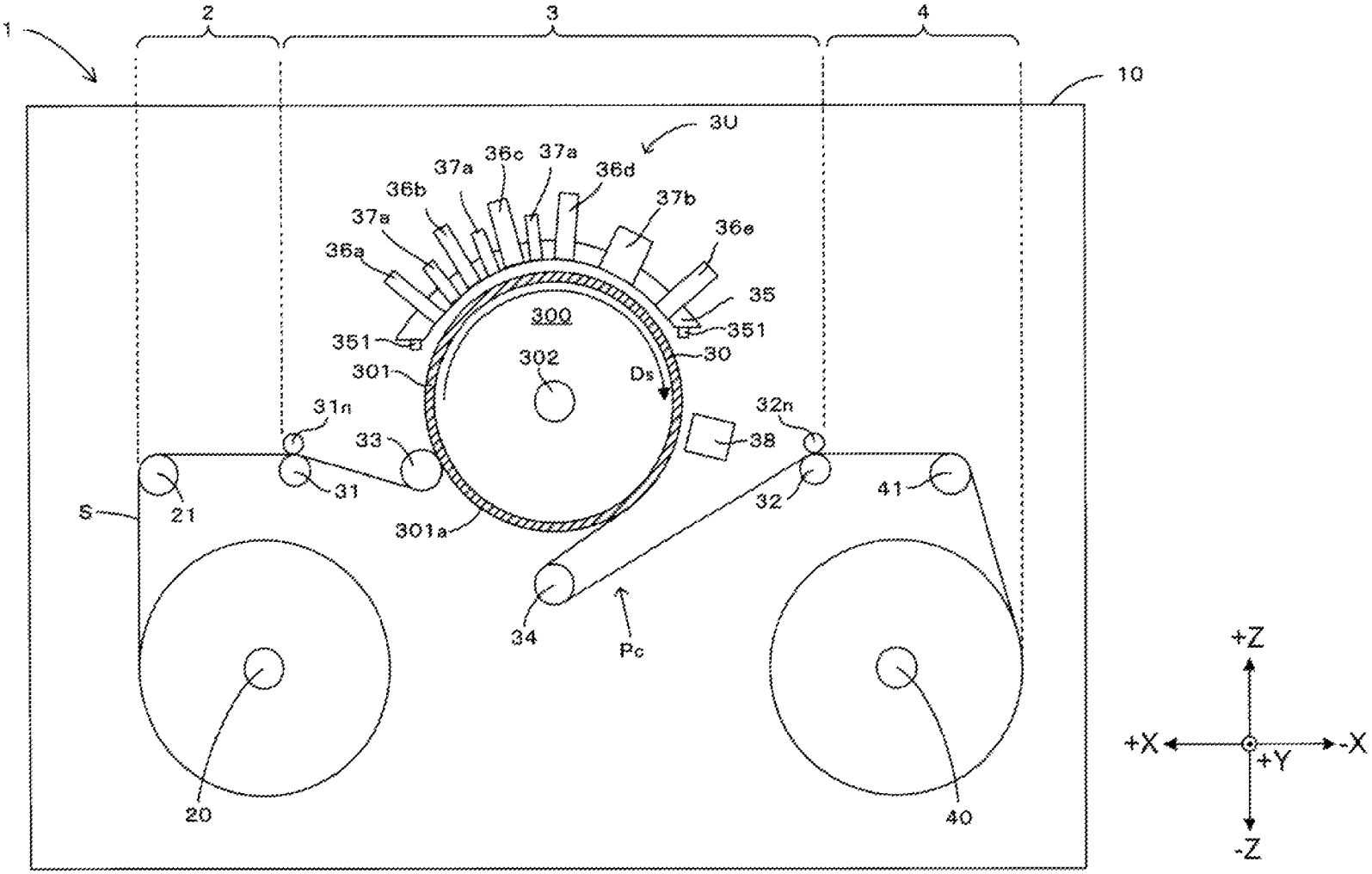
FIG. 1 is a front view schematically illustrating a configuration of a printing apparatus.
Figure 2:
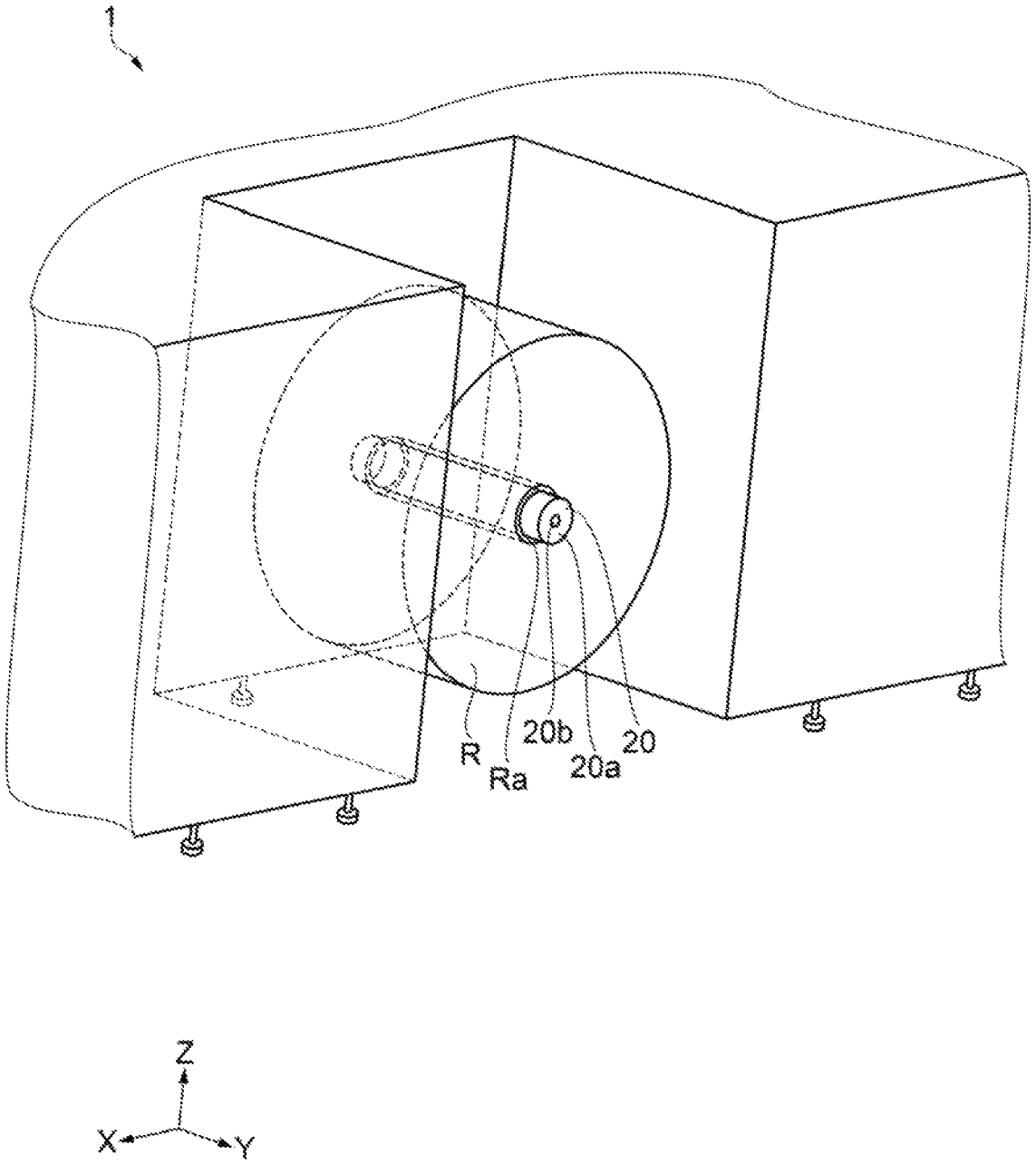
FIG. 2 is a perspective view illustrating a part of the configuration of the printing apparatus.

FIG. 1 is a front view schematically illustrating a configuration of a printing apparatus 1. FIG. 2 is a perspective view illustrating a part of the configuration of the printing apparatus 1. Note that an XYZ orthogonal coordinate system is illustrated in FIG. 1 and FIG. 2.

A feeding section 2, a processing section 3, and a winding section 4 are arranged in the printing apparatus 1. The feeding section 2, the processing section 3, and the winding section 4 are housed in a housing member 10 serving as an outer packaging member. The feeding section 2 and the winding section 4 include a feeding shaft 20 and a winding shaft 40, respectively. Then, a sheet S, which is a recording medium, is wound in a roll shape on the feeding shaft 20 and the winding shaft 40. The sheet S is fed from the feeding shaft 20 to the processing section 3 along a feed path Pc, and, after being subject to printing processing in a processing unit 3U, is fed to the winding shaft 40. Types of the sheet S are broadly divided into a paper-based type and a film-based type. To give specific examples, the paper-based type includes high quality paper, cast-coated paper, art paper, coated paper, and the like, and the film-based type includes synthetic paper, polyethylene terephthalate (PET), polypropylene (PP), and the like. Note that in the following description, of both surfaces of the sheet S, the surface on which an image is recorded is referred to as a top surface and the surface on the reverse side to the top surface is referred to as a back surface.

The feeding section 2 includes the feeding shaft 20 that is a shaft on which is mounted a roll body R around which the sheet S is wound in a roll shape, and a driven roller 21 onto which the sheet S pulled out from the roll body R mounted on the feeding shaft 20 is hooked.

As illustrated in FIG. 2, the feeding shaft 20 is a cylindrical body protruding in a positive Y direction. Then, when the feeding shaft 20 rotates in the clockwise direction as seen on paper in FIG. 1, the sheet S of the roll body R supported by the feeding shaft 20 is fed to the processing section 3 via the driven roller 21.

The roll body R includes a hollow core tube Ra, and the long sheet S is wound around the core tube Ra. The roll body R is detachably supported on the feeding shaft 20 via the core tube Ra. Thus, when the sheet S of the roll body R supported by the feeding shaft 20 has been used up, the roll body R can be replaced by removing the core tube Ra from the feeding shaft 20, and mounting the core tube Ra of the new roll body R on the feeding shaft 20.

The processing section 3 prints the image on the sheet S by performing processing, as appropriate, using the processing unit 3U disposed along an outer circumferential surface

301*a* of a rotating drum 30, while supporting the sheet S fed out from the feeding section 2, using the rotating drum 30. In the processing section 3, a front driving roller 31 and a rear driving roller 32 are provided on both sides of the rotating drum 30, and the processing to print the image is performed in a state in which the sheet S fed from the front driving roller 31 to the rear driving roller 32 is supported by the rotating drum 30.

A plurality of minute protrusions are formed on the outer circumferential surface of the front driving roller 31 by thermal spraying, and the front driving roller 31 picks up and winds the sheet S fed from the feeding section 2, from the back surface side of the sheet S. In addition, when the front driving roller 31 rotates in the clockwise direction as seen on paper in FIG. 1, the sheet S fed from the feeding section 2 is fed downstream along the feed path Pc. Note that a nip roller 31*n* is provided with respect to the front driving roller 31. This nip roller 31*n* is in contact with the top surface of the sheet S while being urged toward the front driving roller 31, and the sheet S is clamped between the nip roller 31*n* and the front driving roller 31. In this way, it is possible to secure a frictional force between the front driving roller 31 and the sheet S and reliably feed the sheet S using the front driving roller 31.

The rotating drum 30 is a cylindrical drum having a central axis parallel to the Y-axis. The rotating drum 30 includes an outer circumferential member 301. A hollow portion 300 that penetrates the rotating drum 30 along the Y axis is formed in a portion defined by the outer circumferential member 301. Then, the sheet S is wound over the outer circumferential surface 301*a* of the outer circumferential member 301 that surrounds the hollow portion 300. In addition, inside the hollow portion 300, the rotating drum 30 includes a rotating shaft 302 extending along the Y-axis passing through a center line of the cylindrical shape of the rotating drum 30. The rotating shaft 302 is rotatably supported by a support mechanism, which is not illustrated, and the rotating drum 30 rotates around the rotating shaft 302.

The sheet S fed from the front driving roller 31 to the rear driving roller 32 is wound over the outer circumferential surface 301*a* of the rotating drum 30 from the back surface side of the sheet S. Then, the rotating drum 30 supports the sheet S from the back surface side of the sheet S while being driven to rotate in a feed direction Ds of the sheet S as a result of receiving a frictional force between the rotating drum 30 and the sheet S. In the processing section 3, driven rollers 33 and 34 are provided that fold back the sheet S on both sides of a wound-over portion of the sheet S wound over the rotating drum 30. Of these, the driven roller 33 picks up and winds the top surface of the sheet S between the front driving roller 31 and the rotating drum 30, and folds back the sheet S. On the other hand, the driven roller 34 picks up and winds the top surface of the sheet S between the rotating drum 30 and the rear driving roller 32, and folds back the sheet S. In this way, by folding back the sheet S respectively upstream and downstream of the rotating drum 30 in the feed direction Ds, it is possible to secure a long length of the wound-over portion of the sheet S wound over the rotating drum 30.

A plurality of minute protrusions are formed on the outer circumferential surface of the rear driving roller 32 by thermal spraying, and the rear driving roller 32 picks up and winds the sheet S, which has been fed from the rotating drum 30 via the driven roller 34, from the back surface side of the sheet S. Then, when the rear driving roller 32 rotates in the clockwise direction as seen on paper in FIG. 1, the sheet S is fed toward the winding section 4. Note that a nip roller 32*n* is provided with respect to the rear driving roller 32. This nip roller 32*n* is in contact with the top surface of the sheet S while being urged toward the rear driving roller 32, and the sheet S is clamped between the nip roller 32*n* and the rear driving roller 32. In this way, it is possible to secure a frictional force between the rear driving roller 32 and the sheet S and reliably feed the sheet S using the rear driving roller 32.

In this way, the sheet S fed from the front driving roller 31 to the rear driving roller 32 is supported by the outer circumferential surface 301*a* of the rotating drum 30. In addition, in order to print a color image on the top surface of the sheet S supported by the rotating drum 30, the processing unit 3U is provided in the processing section 3. The processing unit 3U includes an arc-shaped unit supporting member 35 extending along the outer circumferential surface 301*a* of the rotating drum 30. The unit supporting member 35 supports printing heads 36*a* to 36*e* as ejecting heads, and UV irradiators 37*a* and 37*b*.

The four printing heads 36*a* to 36*d* aligned in the feed direction Ds in this order respectively correspond to yellow, cyan, magenta, and black, and eject ink, as a color liquid compatible with the inkjet method, from nozzles. These four printing heads 36*a* to 36*d* are disposed in a shape radiating from the rotating shaft 302 of the rotating drum 30, and are aligned along the outer circumferential surface 301*a* of the rotating drum 30. Then, each of the printing heads 36*a* to 36*d* is positioned relative to the rotating drum 30 by the unit supporting member 35, and faces the rotating drum 30 with a slight clearance with respect to the outer circumferential surface 301*a* of the rotating drum 30. In this way, each of the printing heads 36*a* to 36*d* faces the top surface of the sheet S wound over the rotating drum 30, with a predetermined platen gap therebetween. In the state in which the platen gap is prescribed in this way by the unit supporting member 35, as a result of the ink being ejected from each of the printing heads 36*a* to 36*d*, the ink lands at a desired position on the top surface of the sheet S, and the color image is formed on the top surface of the sheet S.

An ultraviolet (UV) ink, which is cured by being irradiated with ultraviolet radiation, is used as the ink used in the printing heads 36*a* to 36*d*. Thus, in order to cure and fix the ink on the sheet S, the processing unit 3U is provided with the UV irradiators 37*a* and 37*b*. Note that this ink curing is performed in two separate stages of temporary curing and final curing. The UV irradiators 37*a* for the temporary curing are respectively disposed between each of the four printing heads 36*a* to 36*d*. In other words, by irradiating relatively weak ultraviolet radiation, the UV irradiators 37*a* are used to cure the ink to a degree such that the ink does not lose its shape, and are not used to completely cure the ink. On the other hand, the UV irradiator 37*b* for final curing is provided downstream of the four printing heads 36*a* to 36*d* in the feed direction Ds. In other words, the UV irradiator 37*b* is used to completely cure the ink, by irradiating ultraviolet radiation stronger than the ultraviolet radiation of the UV irradiators 37*a*. In this way, the color image formed by the plurality of printing heads 36*a* to 36*d* can be fixed to the top surface of the sheet S using the UV irradiators 37*a* and 37*b*.

Further, the printing head 36*e* is provided downstream of the UV irradiator 37*b* in the feed direction Ds. The printing head 36*e* ejects transparent UV ink from the nozzles using the inkjet method. The printing head 36*e* is positioned relative to the rotating drum 30 using the unit supporting member 35, and faces the rotating drum 30 with a slight clearance with respect to the outer circumferential surface 301*a* of the rotating drum 30. In this way, each of the printing heads 36*a* to 36*e* faces the top surface of the sheet S wound over the rotating drum 30, with the predetermined platen gap therebetween. In the state in which the platen gap is prescribed in this way by the unit supporting member 35, as a result of the ink being ejected from the printing head 36*e*, the ink lands at a desired position on the top surface of the sheet S, and the color image on the top surface of the sheet S is covered with the transparent ink.

In this way, the printing heads 36*a* to 36*e*, and the UV irradiators 37*a* and 37*b* are attached to the unit supporting member 35, and configure the processing unit 3U. Note that the unit supporting member 35 spans, in the X-axis direction, two rails 351 extending along the Y-axis, and is movable along the Y-axis on the rails 351, thus also moving the printing heads 36*a* to 36*e* and the UV irradiators 37*a* and 37*b*. Then, when the printing is performed on the sheet S, the unit supporting member 35 is positioned at a printing position facing the rotating drum 30. On the other hand, when an operator performs maintenance on the printing heads 36*a* to 36*e* and the UV irradiators 37*a* and 37*b*, the unit supporting member 35 is positioned at a predetermined work position in which the unit supporting member 35 has been moved in the negative Y direction. This allows the operator to perform maintenance on the printing heads 36*a* to 36*e* and the UV irradiators 37*a* and 37*b* at the work position separated from the rotating drum 30.

In the processing section 3, a UV irradiator 38 is provided downstream of the printing head 36*e* in the feed direction Ds. The UV irradiator 38 is used to completely cure the transparent ink ejected by the printing head 36*e*, by irradiating strong ultraviolet radiation. In this way, the transparent ink covering the color image can be fixed to the top surface of the sheet S.

The sheet S on which the color image is formed by the processing section 3 is fed to the winding section 4 by the rear driving roller 32. In addition to the winding shaft 40 around which the end of the sheet S has been wound, the winding section 4 includes a driven roller 41 that picks up and winds the sheet S between the winding shaft 40 and the rear driving roller 32, from the back surface side of the sheet S. The winding shaft 40 winds the end of the sheet S and supports the sheet S with the top surface of the sheet S facing outward. Specifically, when the winding shaft 40 is rotated in the clockwise direction as seen on paper in FIG. 1, the sheet S fed from the rear driving roller 32 is wound around the winding shaft 40 via the driven roller 41. The sheet S is wound around the winding shaft 40 via a core tube (not illustrated) that is detachable from the winding shaft 40. Thus, when the winding shaft 40 on which the sheet S is wound becomes full, it is possible to detach the sheet S together with the core tube.

Figure 3:
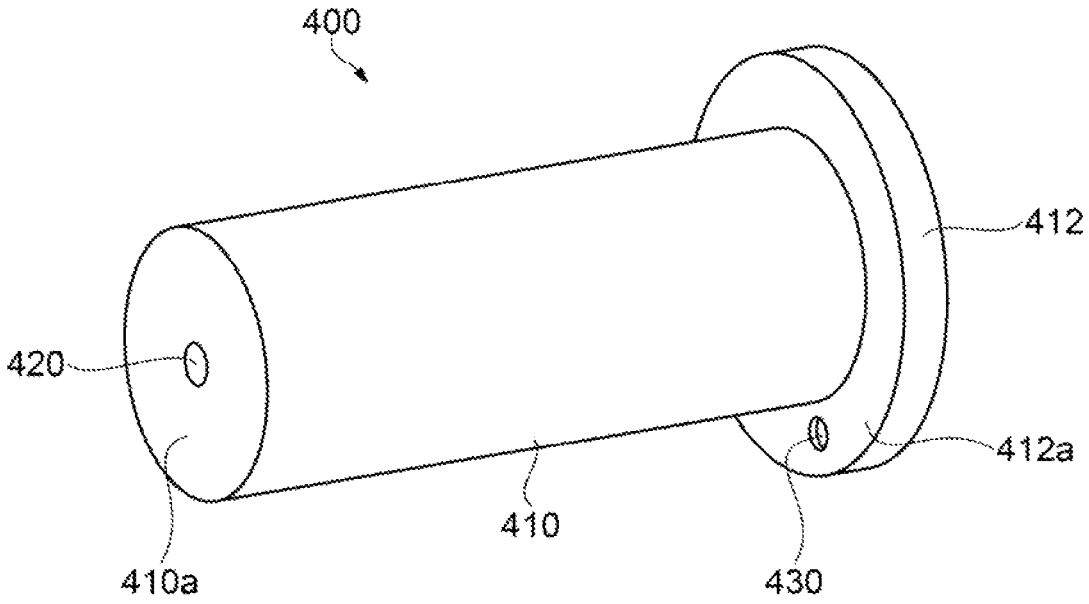
FIG. 3 is a perspective view illustrating a configuration of an auxiliary member.
Figure 4:
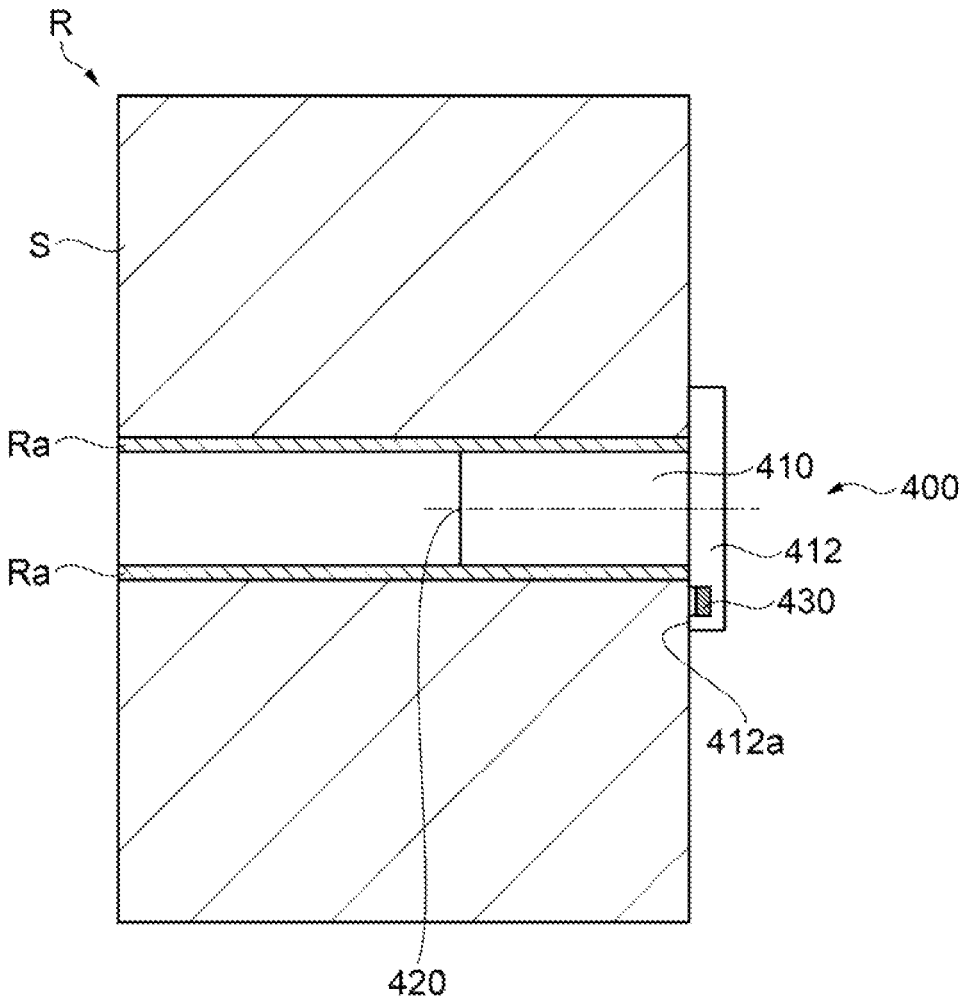
FIG. 4 is a schematic view illustrating a state in which the auxiliary member is mounted in a roll body.

Next, a configuration of an auxiliary member 400 that assists in mounting the core tube Ra of the roll body R onto the feeding shaft 20 of the printing apparatus 1 will be described. FIG. 3 is a perspective view illustrating the configuration of the auxiliary member 400, and FIG. 4 is a schematic view illustrating a state in which the auxiliary member 400 is mounted in the roll body R.

The roll body R used in the printing apparatus 1 of the present embodiment is an object having a relatively heavy weight. For example, one roll body R may have a weight of approximately 100 kg. Therefore, when the core tube Ra of the roll body R is mounted on the feeding shaft 20, it is necessary to support the roll body R using a transport device, such as a forklift, and to align the position of the feeding shaft 20 and the position of the core tube Ra. At this time, the auxiliary member 400 is used to easily align a center position of the feeding shaft 20 and a center position of the core tube Ra.

As illustrated in FIG. 3, the auxiliary member 400 is provided with a cylindrical main body 410 that can be inserted into the core tube Ra of the roll body R, a laser irradiation unit 420 that irradiates laser light from the center of a leading end surface 410*a* of the main body 410, and a switch 430 that switches between irradiation and stopping of the laser light of the laser irradiation unit 420. A cross-sectional shape of the main body 410 along the XZ plane is not limited to being circular, and may be polygonal.

The main body 410 is formed of a plastic member, for example. The diameter of the main body 410 is formed with a dimension that is slightly less than the dimension of the inner diameter of the core tube Ra of the roll body R. In other words, the diameter of the main body 410 is prescribed such that the main body 410 does not significantly rattle when the main body 410 is inserted into the core tube Ra. Further, a length dimension of the main body 410 in the longitudinal direction is shorter than a length dimension in the longitudinal direction of the core tube Ra, is a length dimension that is approximately ⅓ of the length dimension of the core tube Ra, for example, and is a length dimension that is easy to handle.

The laser irradiation unit 420 is provided with a drive circuit, a power source, and the like, that control a laser emitting element and driving of the laser emitting element. Using the switch 430 connected to the power source, the laser irradiation unit 420 is switched between the irradiation and the stopping of the laser light. An opening is provided in a substantially central portion of the leading end surface 410*a*, which serves as one end surface of the cylindrical main body 410, and a red laser light, for example, is irradiated from the opening toward the outside. In this way, when the main body 410 is inserted into the core tube Ra of the roll body R, the laser light is irradiated from approximately the center of the core tube Ra. Note that the color of the laser light is not particularly limited.

The switch 430 switches between the irradiation and the stopping of the laser light from the laser irradiation unit 420. The switch 430 of the present embodiment is an optical sensor, and the laser light is irradiated when the main body 410 is inserted into the core tube Ra. The optical sensor is, for example, an infrared proximity sensor. The infrared proximity sensor is configured by a light emitting element that emits infrared light, a light receiving element that receives light and converts the light into an electrical signal, and the like. Note that the optical sensor is not limited to the infrared sensor, and may be, for example, a capacitance sensor, an ultrasonic sensor, or the like.

In the auxiliary member 400 of the present embodiment, the switch 430 is disposed on a base portion 412 connected to the main body 410. The base portion 412 is disposed on the opposite side of the main body 410 from the leading end surface 410*a*. The base portion 412 is formed of a plastic member, for example. The base portion 412 is a member having a dimension larger than the diameter of the core tube Ra. The base portion 412 of the present embodiment has a cylindrical shape and the diameter dimension of the base portion 412 is approximately 1.2 to 1.5 times the diameter dimension of the core tube Ra, for example. In this way, as shown in FIG. 4, when the main body 410 of the auxiliary member 400 is inserted into the core tube Ra, since the dimension of the base portion 412 is larger than the diameter of the core tube Ra, the base portion 412 is not inserted into the core tube Ra. Therefore, the main body 410 inserted into the core tube Ra can be easily removed.

Then, the switch 430 is provided on the side of a surface of the base portion 412 that is on the leading end surface 410*a* side of the main body 410. That is, the switch 430 is provided on the side of a first surface 412*a* that is the surface at which the main body 410 is connected to the base portion 412. More specifically, the switch 430 is provided at a bottom portion of a recessed portion provided in the first surface 412*a*. Note that the switch 430 is disposed such that the light emitting element and the light receiving element are oriented toward the leading end surface 410*a* side of the main body 410. Then, when the main body 410 of the auxiliary member 400 is inserted into the core tube Ra of the roll body R, infrared light emitted from the light emitting element of the switch 430 is reflected by the roll body R, and the reflected light is received by the light receiving element and is converted to an electrical signal. The laser irradiation unit 420 irradiates the laser light when the electrical signal received by the light receiving element reaches a certain level. On the other hand, when the auxiliary member 400 is removed from the core tube Ra, the electrical signal is at or below the certain level, and the irradiation of the laser light is stopped. In this way, it is possible to easily switch the irradiation of the laser light from the laser irradiation unit 420 between the irradiation and the stopping. An installation position of the switch 430 is not limited to the side of the surface of the base portion 412 on the tip surface 410*a* side of the main body 410, and may also be provided on the circumferential surface of the main body 410.

Figure 5:
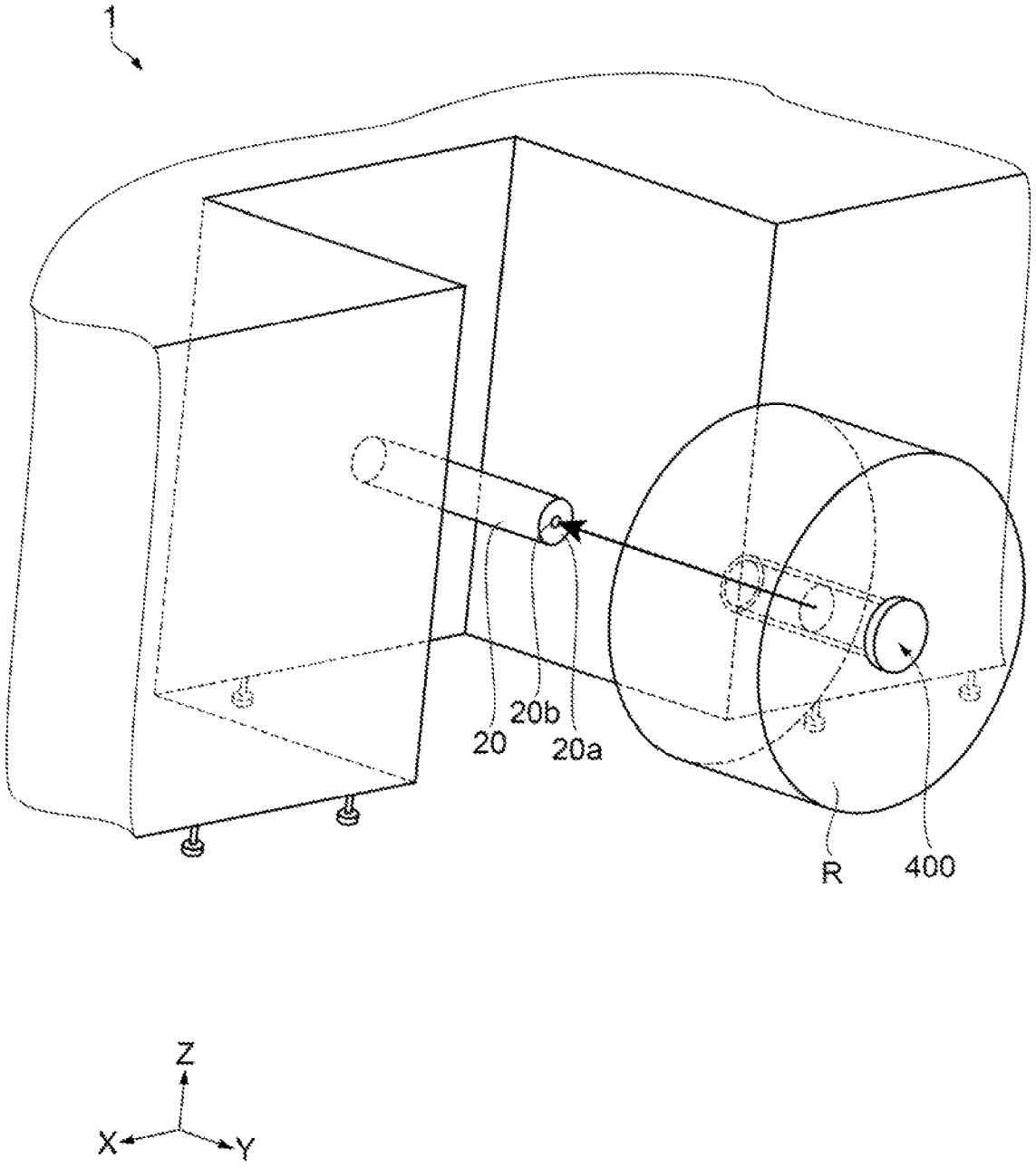
FIG. 5 is a schematic view illustrating a state in which the roll body is mounted in the printing apparatus.

Next, a method for mounting the roll body R on the feeding shaft 20 of the printing apparatus 1 using the auxiliary member 400 will be described. FIG. 5 is a schematic view illustrating a state in which the roll body R is mounted in the printing apparatus 1.

As illustrated in FIG. 5, first, the main body 410 of the auxiliary member 400 is inserted into the core tube Ra of the roll body R. Here, the main body 410 is inserted into the core tube Ra until the insertion of the main body 410 is regulated by the base portion 412. When the main body 410 is inserted into the core tube Ra, the switch 430 is switched ON, and the laser light is irradiated from the laser irradiation unit 420. The laser light is irradiated from the center of the leading end surface 410*a* of the main body 410. That is, the laser light is emitted from substantially the center of the core tube Ra toward the outside.

Next, the roll body R on which the auxiliary member 400 is mounted is lifted by the transport device, such as the forklift. In this case, the roll body R is lifted so that the axial direction of the core tube Ra of the roll body R in the longitudinal direction is substantially parallel to the horizontal plane.

Next, the roll body R is moved so that the leading end surface 410*a* of the main body 410 from which the laser light is emitted and a leading end surface 20*a* of the feeding shaft 20 face each other.

A center position of the core tube Ra of the roll body R is substantially the same as an irradiation position of the laser light irradiated by the laser irradiation unit 420. Therefore, an operator operating the transport device can recognize the center position of the core tube Ra of the roll body R by visually checking the irradiation position at which the laser light is irradiated. Then, the forklift is operated so as to adjust the position of the roll body R while visually checking the irradiation position at which the laser light is irradiated, so that the irradiation position at which the laser light is irradiated is positioned at the center of the leading end surface 20*a* of the feeding shaft 20.

In the present embodiment, a reflection portion 20*b* that reflects the laser light is provided in a central portion of the leading end surface 20*a* of the feeding shaft 20. The reflection portion 20*b* is, for example, a metal piece having a mirror-finished surface. Due to the reflection portion 20*b*, the intensity of the reflected light of the laser light is stronger than at other sections, and therefore, when the reflection portion 20*b* is irradiated with the laser light, it can easily be ascertained to be the central portion of the feeding shaft 20.

Then, after the irradiation position at which the laser light is irradiated is positioned at the center of the leading end surface 20*a* of the feeding shaft 20, the roll body R is moved horizontally toward the feeding shaft 20. As a result, the feeding shaft 20 is inserted into the core tube Ra. In addition, in the course of the feeding shaft 20 being inserted into the core tube Ra, the feeding shaft 20 applies pressure while being in contact with the main body 410 of the auxiliary member 400. Then, when a portion of the main body 410 of the auxiliary member 400 is pushed out of the core tube Ra, the auxiliary member 400 is removed from the core tube Ra. When the auxiliary member 400 is removed from the core tube Ra, the switch 430 is switched OFF, and the irradiation of the laser light from the laser irradiation unit 420 stops. Then, by moving the roll body R to a prescribed position on the feeding shaft 20 side, the mounting of the roll body R in the printing apparatus 1 is complete.

According to the above-described embodiment, the following effects can be obtained.

When the main body 410 of the auxiliary member 400 is inserted into the core tube Ra of the roll body R, the laser light is irradiated from the laser irradiation unit 420. As a result, the laser light is emitted from substantially the center of the core tube Ra. Then, when mounting the core tube Ra of the roll body R on the feeding shaft 20 of the printing apparatus 1, the laser light is irradiated from the core tube Ra of the roll body R toward the feeding shaft 20 of the printing apparatus 1. As a result, the adjustment between the center position of the feeding shaft 20 and the center position of the core tube Ra can be performed while viewing the irradiation position of the laser light. As a result, alignment between the center position of the feeding shaft 20 and the center position of the core tube Ra is easily performed, and the roll body R can be easily mounted on the feeding shaft 20 of the printing apparatus 1.

Note that the present disclosure is not limited to the above-described embodiment, and various modifications and improvements can be added to the above-described embodiment. Modified examples are described below.

Modified Example 1

In the above-described embodiment, the switch 430 of the auxiliary member 400 is the optical sensor, but the present disclosure is not limited to this example. For example, the switch 430 may be a push button. The push button is disposed on the first side 412*a* side of the base portion 412. With this configuration, when the main body 410 is inserted into the core tube Ra, the button is depressed and the laser light is irradiated. With this configuration also, the same effects can be obtained as those described above.

The push button may also be disposed on the opposite side from the first side 412*a* of the base portion 412, or may be disposed on the circumferential surface of the main body 410. When the push button is disposed on the circumferential surface of the main body 410, the configuration is such that the push button is depressed by the inner wall of the core tube Ra when the main body 410 is inserted into the core tube Ra and the laser light is irradiated. Further, when the push button is disposed on the opposite side of the base portion 412 from the first surface 412*a*, the operator can cause the laser light to be irradiated from the laser irradiation unit 420 by pressing the push button, and can stop the irradiation of the laser light by releasing the depression of the push button.

Modified Example 2

In the above-described embodiment, the reflection portion 20*b* that is the metal piece is disposed on the leading end surface 20*a* of the feeding shaft 20, but the present disclosure is not limited to this example. The reflection portion 20*b* may be a light receiving sensor that receives the irradiated laser light. Then, a configuration may be adopted in which, when the laser light irradiated from the laser irradiation unit 420 is received, a sound is emitted from a speaker or the like provided in the printing apparatus 1. According to this configuration, in addition to the visual perception, the center position of the feeding shaft 20 can also be ascertained through auditory perception. Furthermore, a configuration may be adopted in which a display unit provided in the printing apparatus 1 displays the irradiation position of the laser light.

Modified Example 3

A knob that can be gripped by fingers may be disposed on the opposite side from the first surface 412*a* of the base portion 412 of the auxiliary member 400. According to this configuration, handling of the auxiliary member 400 is easily managed.

Modified Example 4

A configuration may be adopted in which the base portion 412 is omitted from the auxiliary member 400. In this case, the switch 430 is installed on the circumferential surface portion of the main body 410. In this manner also, the alignment between the center position of the feeding shaft 20 and the center position of the core tube Ra can be easily performed.

Modified Example 5

In the above-described auxiliary member 400, the opening from which the laser light is irradiated is formed in the substantially central portion of the leading end surface 410*a*, which serves as the one end surface of the cylindrical main body 410, but the present disclosure is not limited to this example. A plurality of openings may be formed surrounding the central portion of the leading end surface 410*a*, and the laser light may be emitted from each of the openings. In this case, the alignment between the center position of the feeding shaft 20 and the center position of the core tube Ra can be performed by positioning the center of the leading end surface 20*a* of the feeding shaft 20 at a center of the irradiation positions of the plurality of irradiated laser lights.

Content derived from the embodiment will be described below.

An auxiliary member is an auxiliary member that assists in mounting a roll body, formed by winding a sheet into a roll shape on a core tube, onto a shaft of a printing apparatus. The auxiliary member includes a cylindrical main body insertable into the core tube, a laser irradiation unit configured to irradiate laser light from a leading end surface of the main body, and a switch configured to switch between irradiation and stopping of the laser light from the laser irradiation unit.

According to this configuration, the laser light is irradiated from the laser irradiation unit while the main body is inserted into the core tube of the roll body. In this way, the laser light is emitted from substantially the center of the core tube. Then, when mounting the core tube of the roll body onto the shaft of the printing apparatus, the laser light can be irradiated toward the shaft of the printing apparatus. As a result, adjustment of a center position of the shaft and a center position of the core tube can be performed while viewing an irradiation position of the laser light. As a result, alignment between the center position of the shaft and the center position of the core tube is easily performed, and the roll body can be easily mounted on the shaft of the printing apparatus.

A switch of the above-described auxiliary member is preferably an optical sensor, and the laser light is preferably irradiated when the main body is inserted into the core tube.

According to this configuration, the laser light is irradiated when the main body is inserted into the core tube, and thus, handling of the auxiliary member is easy.

The switch of the above-described auxiliary member is preferably a push button that is depressed to irradiate the laser light when the main body is inserted into the core tube.

According to this configuration, the laser light is irradiated when the main body is inserted into the core tube, and thus, handling of the auxiliary member is easy.

In the above-described auxiliary member a base portion having a larger dimension than a diameter of the core tube is preferably connected to the main body on an opposite side of the main body from the leading end surface.

According to this configuration, the base portion has a larger dimension than the diameter of the core tube, and thus, when the main body is inserted into the core tube, the base portion is not inserted into the core tube. Therefore, the main body inserted into the core tube can be easily removed.

The switch of the above-described auxiliary member is preferably provided on the side of a surface, of the base portion, to which the main body is connected.

According to this configuration, the operation to cause the laser light to be irradiated is easy.

A printing apparatus includes an auxiliary member including a cylindrical main body insertable into a core tube of a roll body formed by winding a sheet into a roll shape on the core tube, a laser irradiation unit irradiating laser light from a leading end surface of the main body, and a switch switching between irradiation and stopping of the laser light from the laser irradiation unit. The printing apparatus also includes a shaft onto which the core tube of the roll body is mounted, and a reflection portion provided on a leading end surface of the shaft and configured to reflect the laser light.

According to this configuration, the laser light is irradiated from the laser irradiation unit while the main body is inserted into the core tube of the roll body. In this way, the laser light can be irradiated from substantially the center of the core tube toward the shaft. The irradiated laser light is reflected by the reflection portion provided at the central portion of the leading end surface of the shaft. Thus, at the section of the reflection portion, a reflection intensity of the laser light is stronger than at other sections. As a result, the central portion of the leading end surface of the shaft can be easily ascertained, alignment of the center position of the shaft with the center position of the core tube becomes easy, and the roll body can be easily mounted on the shaft of the printing apparatus.

What is claimed is:

1. An auxiliary member that assists in mounting a roll body, formed by winding a sheet into a roll shape on a core tube, onto a shaft of a printing apparatus, the auxiliary member comprising:

a cylindrical main body insertable into the core tube;

a laser irradiation unit configured to irradiate laser light from a leading end surface of the main body; and a switch configured to switch between irradiation and stopping of the laser light from the laser irradiation unit.

2. The auxiliary member according to claim 1, wherein the switch is an optical sensor, and the laser light is irradiated when the main body is inserted into the core tube.

3. The auxiliary member according to claim 1, wherein the switch is a push button that is depressed to irradiate the laser light when the main body is inserted into the core tube.

4. The auxiliary member according to claim 1, wherein a base portion having a larger dimension than a diameter of the core tube is connected to the main body on an opposite side of the main body from the leading end surface.

5. The auxiliary member according to claim 4, wherein the switch is provided on the side of a surface, of the base portion, to which the main body is connected.

6. A printing apparatus comprising:

an auxiliary member including a cylindrical main body insertable into a core tube of a roll body formed by winding a sheet into a roll shape on the core tube, a laser irradiation unit irradiating laser light from a leading end surface of the main body, and a switch switching between irradiation and stopping of the laser light from the laser irradiation unit;

a shaft onto which the core tube of the roll body is mounted; and a reflection portion provided on a leading end surface of the shaft and configured to reflect the laser light.

* * * * *